United States Patent [19]

Kilpeläinen

[11] 4,217,917

[45] Aug. 19, 1980

[54] CHIP WASHER

[75] Inventor: Ossi Kilpeläinen, Savonlinna, Finland

[73] Assignee: Enso-Gutzeit Osakeyhtio, Helsinki, Finland

[21] Appl. No.: 27,815

[22] Filed: Apr. 6, 1979

[30] Foreign Application Priority Data

Apr. 10, 1978 [FI] Finland ..... 781091

[51] Int. Cl.[2] ..... B08B 3/04

[52] U.S. Cl. ..... 134/104; 134/132; 134/133; 15/3.15; 15/3.2; 366/186; 366/320

[58] Field of Search ..... 134/65, 104, 132–134; 15/3.15, 3.2; 366/186, 310, 320

[56] References Cited

U.S. PATENT DOCUMENTS

| | | | |
|---|---|---|---|
| 3,291,076 | 12/1966 | Flanigan et al. | 366/310 X |
| 3,498,839 | 3/1970 | Menta | 134/65 X |
| 3,811,148 | 5/1974 | Martin | 134/132 X |
| 4,022,231 | 5/1977 | Kostiainen et al. | 134/133 |

*Primary Examiner*—Robert L. Bleutge

*Attorney, Agent, or Firm*—Toren, McGeady and Stanger

[57] ABSTRACT

A chip washer comprising a tank holding washing fluid, a conveyor for supplying chips into the tank, a vane for setting the fluid and therewith the chips into motion in the tank, a conduit provided with valve for removal from the tank of the foreign substances separated from the chips and a washed chips removing conveyor, this latter consisting of a screw conveyor ascending obliquely upwardly from the tank with its lower end extending into the washing fluid and the mantle of which is constituted by a strainer tube. The strainer tube of the screw conveyor is encircled by a collecting tube or trough, which returns the washing fluid running off the chips, back to the tank.

3 Claims, 3 Drawing Figures

CHIP WASHER

The present invention concerns a chip dryer including a tank holding washing fluid, a conveyor for feeding the chips into the tank, a vane for agitating the liquid and therewith the chips in the tank, a conduit with a valve for removing from the tank the foreign matter separated from the chips and a conveyor arrangement for removing the washed chips, this conveyor including of an obliquely ascending screw conveyor of which the lower end extends into the washing fluid and the mantle of which includes of a strainer tube.

The chip washer is used to remove from among the wood constituents those foreign substances which could damage the machines employed in cellulose and paper manufacturing, and which would impair the quality of the pulp and paper. Such foreign matter is typically bark, stones, sand, glass shards, scrap iron, etc. The washing fluid used in chip washers is commonly water or white liquor, but other washing liquids may also be considered.

In the prior art, a chip washer is known by U.S. Pat. No. 4,022,231. This chip washer has the drawback that large quantities of washing fluid escape along with the chips, and separate equipment is needed for its separation from the chips.

The object of the present invention is to provide a new type of chip washer wherein the separation of the washing fluid from the washed chips takes place in the chip removing conveyor. The invention is characterized in that the strainer tube of the screw conveyor is encircled by a collecting tube or trough, which returns to the tank the washing fluid running off the chips. As the washed chips proceed at a comparatively low speed upwardly, lifted by the screw conveyor, the washing fluid will run off the chips through the strainer tube and along the collecting tube or trough.

It was necessary, owing to mechanical reasons, that there be a clearance of about 20 to 30 mm between a conventional conveyor screw and the strainer tube, and this caused a chip layer to accumulate on the surface of the strainer tube which the screw would not scrape off. This layer impeded the passage of water through the tube. In order to eliminate this drawback, the screw of the screw conveyor of the invention is flexible enough to cause it to drag along the mantle of the screw conveyor, or the strainer tube. The strainer tube is kept clean by this means.

Flexibility of the screw conveyor is achieved, for instance, in that the screw has no shaft in its portion opposite the mantle or strainer tube. It is advantageous, on the other hand, to carry the screw of the screw conveyor in bearings at its top end only, whereby it is caused to drag without restraint against the inner surface of the strainer tube.

The invention is described in the following with reference being made to the attached drawing, wherein.

Figure 1:
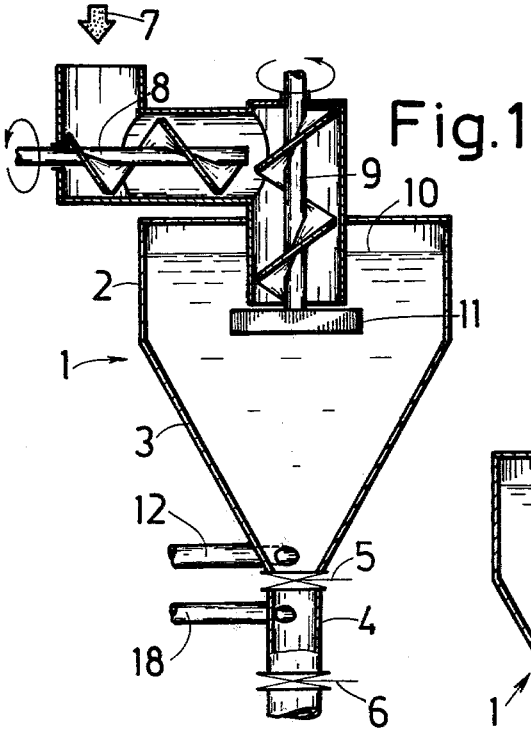
FIG. 1 is an elevational, sectional view of the chip washer of an embodiment of the invention, the chip removing conveyor having omitted in the figure for the sake of clarity.
Figure 2:
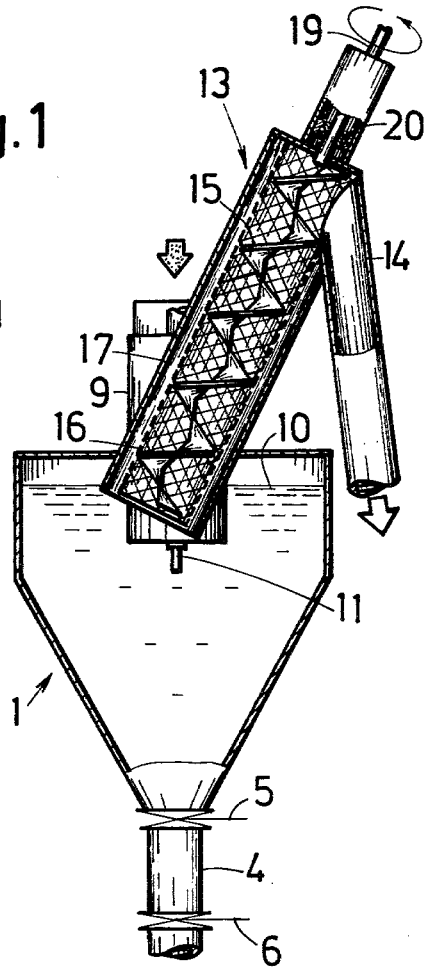
FIG. 2 is an elevational, sectional view of the chip washer from the righthand side of FIG. 1, including the chip removing conveyor.
Figure 3:
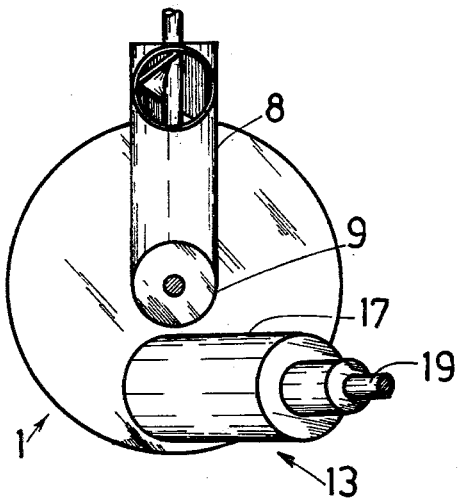
FIG. 3 shows the same chip washer in top view.

In the drawing, the reference numeral 1 indicates the tank of the chip washer, having an upper cylindrical part 2 and a lower, conical part 3. From the lower end of the conical part 3 extends downwardly a conduit 4, in which stop valves 5 and 6 have been mounted.

The wood chips to be washed are supplied in the direction of arrow 7 by the screw conveyor 8. Subsequently, the screw conveyor 9 pushes the chips to be washed in under the surface 10 of the washing fluid in the tank 1. The shaft of the screw conveyor 9 carries at its lower end a vane 11, which puts into rotation the washing fluid and chips in the tank 1, whereby the impurities separate from the chips and settle downwardly. The valve 5 is open and the valve 6 closed, whereby the impurities accumulate in the conduit 4. Through the pipe 12, water or washing fluid enters the conical part 3 of the tank and lifts the soaked chips upwardly, whereby only impurities go into the conduit 4.

The chips rising to the surface 10 of the washing fluid are removed in an oblique upward direction with the aid of the ascending screw conveyor 13. The chips fall from the upper end of the screw conveyor 13 into the tube 14, whence they are carried forward in the process. The screw 15 of the screw conveyor 13 is surrounded by a strainer tube 16, through which the washing fluid runs into the collecting tube 17 and thence back into the tank 1. The strainer tube keeps clean and open since at this point the screw 15 lacks a shaft and the screw is flexible enough to drag lightly against the inner surface of the strainer tube 16. For the same reason the lower end of the screw has not been provided with a bearing. In contrast, there is a bearing 20 for a shaft 19 at the top end of the screw.

The impurities are removed from the conduit 4 by opening the valve 6 and introducing water through the pipe 18 under pressure. When the conduit 4 has been emptied, the valve 6 is closed and valve 5 opened.

It is obvious to a person skilled in the art that different embodiments of the invention may vary within the scope of the claims presented below. This concerns, for instance, the inclination of the chip removing conveyor and the length of the conveyor. The steeper the ascent of the conveyor 13 and the greater its length, the higher is the efficiency with which the washing fluid is separated from the chips.

I claim:

1. A chip washer comprising a tank for holding a washing fluid, means for supplying chips to be washed into said tank, means for imparting movement to the fluid together with the chips within said tank, a conduit including a valve coupled to said tank for removing foreign substances separated from the chips in said tank, and means for removing washed chips from said tank, said removing means including a flexible screw conveyor extending obliquely in the axial direction thereof relative to the surface of the washing fluid, the lower end of said screw conveyor being below the surface of the fluid, means for supporting said conveyor for rotation about its axis, a strainer tube enclosing said screw conveyor and being coaxially aligned therewith so that the inner wall of said strainer tube contacts the radially outer edge of said conveyor, said conveyor being sufficiently flexible so that its outer edge can be dragged against the inner surface of said strainer tube to prevent clogging of said strainer tube when said conveyor is rotated, and a collecting tube radially outwardly spaced from said strainer for returning washing fluid which runs off the chips through said strainer tube to said tank when the chips are being removed from said tank.

2. A chip washer according to claim 1, wherein the portion of said screw conveyor enclosed within said strainer tube is axially unsupported.

3. A chip washer according to claim 1, wherein said supporting means includes a bearing at only the upper end of said screw conveyor.

* * * * *